US006761699B2

(12) United States Patent
Chahine

(10) Patent No.: US 6,761,699 B2
(45) Date of Patent: Jul. 13, 2004

(54) METHOD OF RESTORING SPEECH FUNCTIONS IN PATIENTS SUFFERING FROM VARIOUS FORMS OF DYSARTHRIA, AND DYSARTHRIA PROBES

(76) Inventor: Elvina Ivanovna Chahine, 6300 N. Claremont Ave. Apt. 2, Chicago, IL (US) 60659

( * ) Notice: Subject to any disclaimer, the term of this patent is extended or adjusted under 35 U.S.C. 154(b) by 164 days.

(21) Appl. No.: 09/066,317

(22) PCT Filed: Apr. 23, 1996

(86) PCT No.: PCT/RU96/00097

§ 371 (c)(1),
(2), (4) Date: Apr. 28, 1998

(87) PCT Pub. No.: WO97/16153

PCT Pub. Date: May 9, 1997

(65) Prior Publication Data

US 2001/0020141 A1 Sep. 6, 2001

(30) Foreign Application Priority Data

Oct. 31, 1995 (RU) ..... 95117984

(51) Int. Cl.[7] ..... A61H 21/00; A61H 7/00

(52) U.S. Cl. ..... 601/135; 601/134; 601/137; 606/201

(58) Field of Search ..... 601/123, 125, 601/128–129, 134–139, 119–120, 141, 142, 107, 111, 17; 606/201, 190, 159, 161, 204; 15/110, 111, 117, 121; 81/3.55; 30/129, 137, 147, 148, 150, 322, 323; D24/214.211; D7/653; 433/141; 446/85–86

(56) References Cited

U.S. PATENT DOCUMENTS

| | | | | | |
|---|---|---|---|---|---|
| 80,226 | A | * | 7/1868 | Sharpener | 30/322 |
| D25,384 | S | * | 4/1896 | Dazun | 30/322 |
| D32,785 | S | * | 6/1900 | Osgood | 30/322 |
| D35,313 | S | * | 11/1901 | Wirt | 601/137 |
| 687,363 | A | * | 11/1901 | Wirt | |
| 865,620 | A | * | 9/1907 | Vasconcelles | 30/322 |
| D40,158 | S | * | 7/1909 | Apfel | D24/211 |
| 1,086,936 | A | * | 2/1914 | Hnaske | 601/135 |

(List continued on next page.)

FOREIGN PATENT DOCUMENTS

| | | | | |
|---|---|---|---|---|
| DE | 1491559 | * | 10/1969 | 601/139 |
| FR | 1093795 | * | 5/1955 | 601/107 |
| GB | 261902 | * | 12/1926 | 601/107 |
| IT | 347284 | * | 7/1937 | 601/137 |

*Primary Examiner*—Justine R. Yu
(74) *Attorney, Agent, or Firm*—Anderson Kill & Olick; Eugene Lieberstein; Michael N. Meller

(57) ABSTRACT

A method for restoring speech functions in patients having various forms of dysarthria by way of successively carrying out the cosmetic massage of the face, the point massage of biologically active points of the face, cervical-collar region, arms and articulation organs, articulation-mimic gymnastics followed by voice exercises. The point massage is carried out by successively pressing, pricking, stroking for 1–5 seconds 3–5 times for 3–5 points, by sequentially alternating same and by adding 1–2 points. Pair points are massaged with two probes simultaneously.

Dysarthria probes for carrying out a method for restoring speech functions by way of exerting a reflex action on the patient's biologically active points, which comprise a rod and an operating part whose configuration is varied in relation to the patient's clinical profile, for example, in the form of a ball, a sphere, an oval, a two-prong unit or a three-prong unit.

The operating parts of the probes are made of ebonite, copper, titanum and/or stainless steel and can be dismantled.

5 Claims, 5 Drawing Sheets

U.S. PATENT DOCUMENTS 1,380,247 A * 5/1921 Price ..... 30/142
1,908,051 A * 5/1933 Reichl
1,915,190 A * 6/1933 Koment ..... 601/107
D98,252 S * 1/1936 Hemp ..... D24/211
2,087,938 A * 7/1937 Strozut ..... 30/322
D127,824 S * 6/1941 Garas ..... D24/211
2,322,503 A * 6/1943 Bowman ..... 30/142
2,569,237 A * 9/1951 Hall ..... 606/161
2,691,978 A * 10/1954 Kirby ..... 128/57
D175,093 S * 7/1955 Polk ..... D7/663
D185,246 S * 5/1959 Taran ..... D24/211
D252,180 S * 6/1979 Zuber ..... D7/106
4,167,063 A * 9/1979 Sosnay ..... 32/66
D253,155 S * 10/1979 Jurida ..... D24/211
D258,687 S * 3/1981 Katsube ..... D24/211
D272,033 S * 1/1984 Saucier ..... D7/653
4,601,662 A * 7/1986 Galler ..... 433/226
4,785,800 A 11/1988 Stilson
4,836,781 A * 6/1989 Meinershagen ..... 433/141
4,959,067 A * 9/1990 Muller ..... 606/190
4,989,585 A * 2/1991 Auker ..... 601/111
4,993,408 A 2/1991 Schweisfurth
D317,204 S * 5/1991 Henneseey ..... D24/211
5,019,033 A 5/1991 Geria
5,176,754 A * 1/1993 Hirzel ..... 118/258
D336,959 S * 6/1993 Liming ..... D24/214
5,358,507 A * 10/1994 Daily ..... 606/159
D357,984 S * 5/1995 Heck ..... D24/211
D359,124 S * 6/1995 Rosenberg ..... D24/211
5,445,163 A 8/1995 Machacek
D370,729 S * 6/1996 Hurlburt et al. ..... 601/137
5,525,059 A * 6/1996 Lee ..... 433/141
5,530,983 A * 7/1996 Maltese ..... 601/15
5,560,746 A * 10/1996 Willow ..... 601/135
5,622,492 A * 4/1997 Eli ..... 433/3

* cited by examiner

METHOD OF RESTORING SPEECH FUNCTIONS IN PATIENTS SUFFERING FROM VARIOUS FORMS OF DYSARTHRIA, AND DYSARTHRIA PROBES

TECHNICAL FIELD

The invention relates to medicine, more specifically to treatment of speech disorders, e.g. various forms of dysarthria.

PRIOR ART

Defects of pronunciation in case of dysarthria are due to the organically insufficient innervation of organs of speech most frequently as a result of paresis and the muscular paralysis of articulation organs. Characteristic for dysarthria is a limited mobility of speech organs: the soft palate, tongue and lips because of affection of muscles.

Very popular in practical medicine are methods for normalising a patient's speech, which include the preliminary examination of the patient and the subsequent mimic muscle gymnastics, teaching the patient how to pronounce syllables using pedagogic methods and also elements of breathing exercises (cf. The book by F. A. Rau et al. "Methods of teaching deaf-mutes to pronounce", 1948, Uchpedgiz, Moscow, page 178).

Known in the art is a device for a mechanical effect exerted on the tongue in training and correcting the pronunciation of certain sounds of speech in the case of some forms of speech disorders, which comprises a handgripportion and a working member. This device (logopedics probe) performs the function of an auxilary technical means in some cases to assimilate articulation required and does not contribute to normalizing the muscle tone. The use of logopedics probes leads to a quick fatigue of speech therapeutist's hands because of the inconvenient use of probes (when placed in the patient's mouth) in consequence of a change in the structure of petient's articulation organs and requires the speech therapeutist's great efforts. Besides, the logopedics probes are mainly used in training sounds to adjust vocal organs in a position of pronunciation in case of tongue-tie, lateral and sibilant sigmatisms, dental and interdental sigmatisms and also when working with deaf-mutes (cf. Defectologicheskii Slovar, 1970, Pedagogika Publishers, Moscow, page 122).

Known is a kit of the type used for exerting a reflex action on points and regions in case of affected supporting-motorial organs, bronchial asthma, neuralgias, joint formations, which comprises a casing accommodating at least three probes whose operating parts are embodied in the form of streamline mushroom elements and a tapering rod. This kit does not enable one to perform point action on the biologically active points of the articulation organs and to achieve a desired effect when exerting action on the biologically active points of the face, arms and the cervical-collar region, which is necessary to realize modem speech therapy methods (cf. RU 2034528, 1995).

As can really be seen from the afore-said, persons skilled in the art possess a small number of steps for correcting speech defects, directed, as a rule, to correcting pronunciation and speech breath.

Also, speech therapy resides in narrow training exercises to be done along with the other medical procedures.

At the same time, conventional methods for removing speech defects cannot satisfy needs of medicine in full, because these do not possess a required complex of properties to enhance the efficiency of tretment.

DISCLOSURE OF THE INVENTION

It is the principal object of the present invention to provide an integrated approach to the problem of restoring speech functions in patients suffering from various forms of dysarthria.

The integrated approach consists in working out a method of restoring speech functions in patients with such disturbances and in developing a kit of dysarthria probes enabling one to perform the point massage of biologically active points whose configuration of operating members is varied in relation to the patient's clinical profile. The task set is solved owing to the fact that the muscle tone of articulation organs is normalized through the all-out method of restoring the speech functions of articulation organs, with the use of probes for the point massage of biologically active points, action on which, according to a certain diagram, results in stimulating the nervous ends and muscles associated with biologically active points. Stimulation is attained by pressing, pricking (to cause or to restore sensitivity that is lowered or absent in patients) and stroking actions to be advantageously exerted by different probes. Action is made by retarding or an exciting method. The configuration of the operating members of probes is varied and dictated by the demands of effects exerted by the speech therapeutist, which are established in relation to the clinical profile by the speech therapeutist himself.

The probes are made of various materials having good conductive and electromagnetic properties—ebonite, titanium, stainless steel, copper and can, for example, be made from plastic material, glass, rock crystal. In case of retardation action it is advisable to use ebonite probes and metallic ones—in excitation. All the probes have well polished surfaces.

BEST MODE OF CARRYING OUT THE INVENTION

Figure 29:
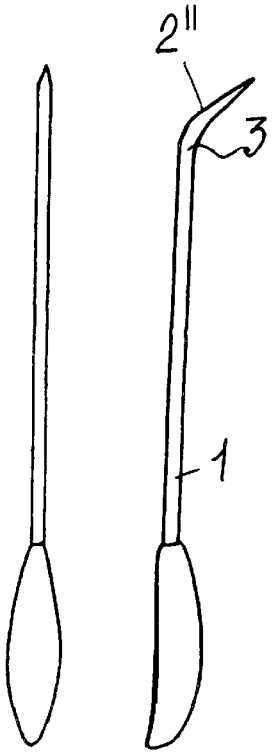

The method is carried out in the following manner. A patient is seated in a chair in a convenient posture and the cosmetic massage is done his/her face by the fingers of speech therapeutist's hands. Clothes are then removed from the body's parts liable to point massage is done on the biologically active points of the face and the cervical-collar region. The points for action and an instrument are chosen according to special methods, for which purpose a probe with an operating part in the form of a ball-like head acts first upon point 1 (FIG. 1) in a recess in the chin, followed by a two-prong unit pressing pair points 2 which are situated near the corners of the mouth, repeating the action on the same points by pricking, using a probe having an operating part in the form of a needle (FIG. 29).

Figure 1:
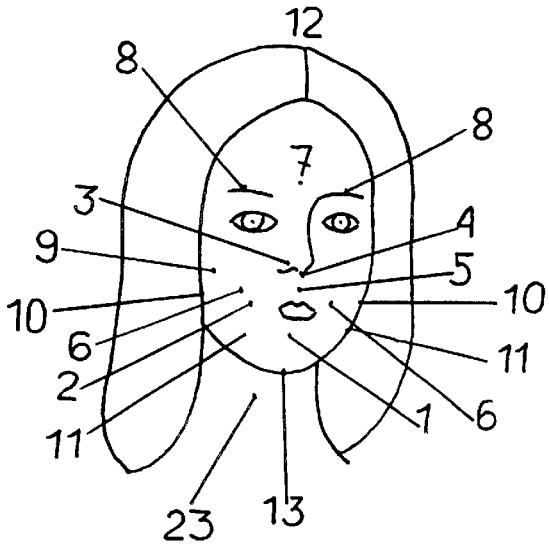
FIGS. 1–13 show the certain diagrams of an effect exerted by point massage on the biologically active points of the face, cervical-collar region, arms, patient's tongue, throat.
Figure 2:
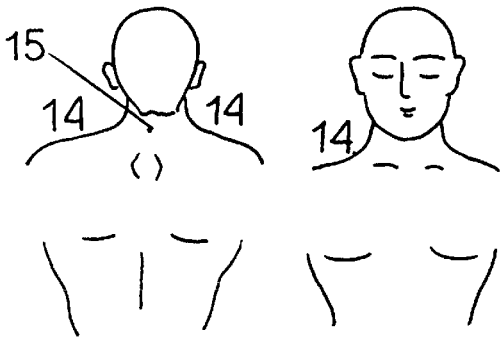
Figure 3:
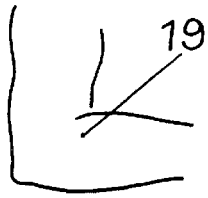
Figure 4:
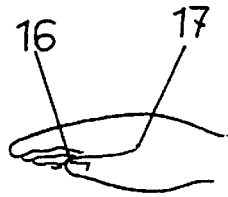
Figure 5:
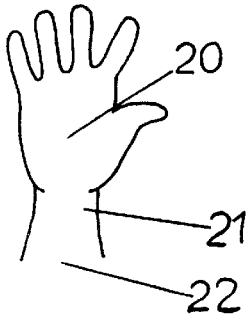
Figure 6:
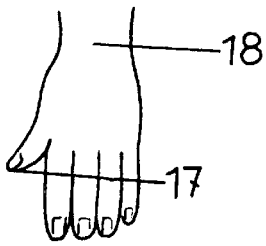
Figure 7:
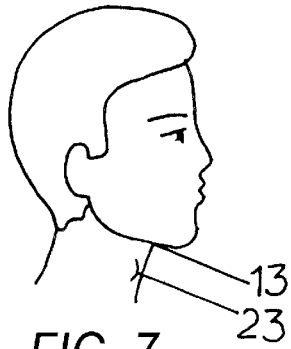
Figure 8:
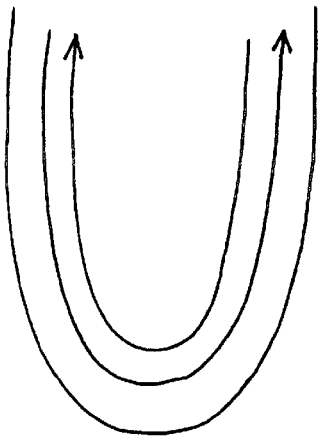
Figure 9:
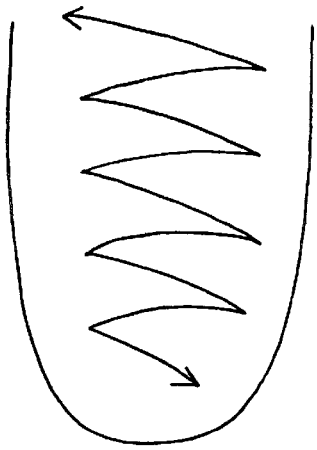
Figure 10:
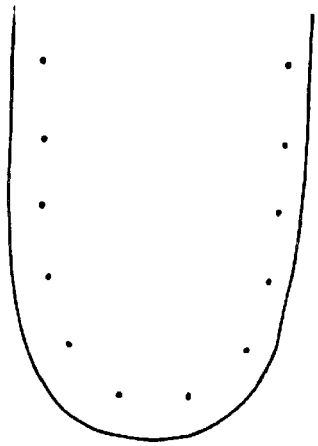
Figure 11:
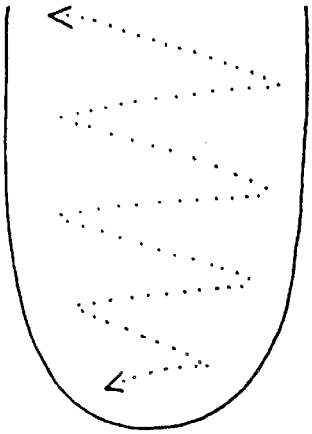
Figure 12:
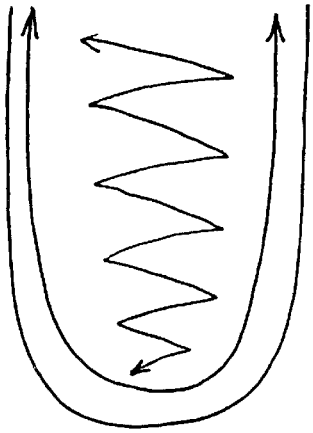

Pressing and pricking procedures are then carried out in succession for other ten facial points as well(FIG. 1).

Exposure for each and every point is 1–5 seconds and action is repeated 3–5 times by way of pressing, pricking and stroking.

3–5 points are acted upon in a single procedure and 1–2 points are added thereto.

Figure 17:
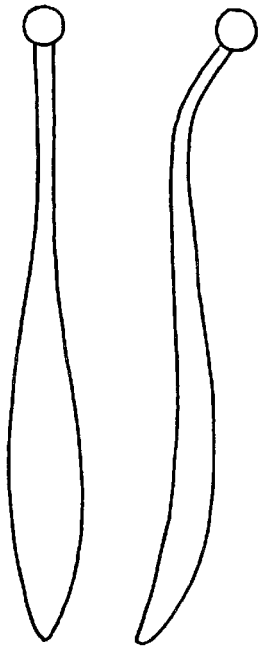
Figure 18:
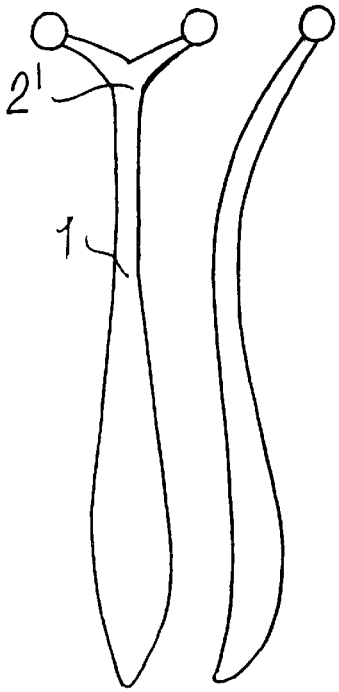
Figure 19:
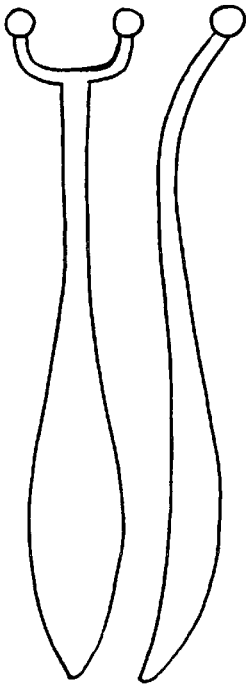

At the end of the procedure, facial massage is carried out with the aid of the handgrip portions of ebonite probes (FIGS. 17, 18) or a probe in the form of a little mushroom (FIGS. 31–33) on the massage lines from the center of the chin to the ears.

On massaging the cervical-collar region, acted upon are first points 13 and 23 (FIG. 1) and preferable thereat is the use of a probe in the form of a little mushroom, by sequentially pressing points 12, 14 and 15, using the same probe. After this points 16, 17, 12, 18, 20, 21, 22 are stimulated by a probe with a ball-like head and then by one in the form of a needle (FIG. 29).

Exposure lasts 1–5 seconds 4–5 times. Points 20, 21, and 22 are activated in cases when there is paresis of an arm.

Figure 13:
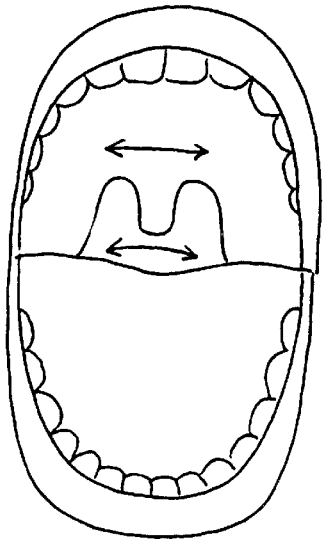

On massaging the arms, acted upon are points 14, 16, 17, 18 and 19 according to the above-mentioned diagram. The points of articulation organs are massaged in several stages. First affected are points disposed on the tongue according to the diagram shown in FIGS. 8–12, then beneath the tongue, on the palata curtain, the uvula and on the rear wall of the phrynx (FIG. 13).

On massaging the patient's tongue, he/she is seated before a mirror, a probe (FIG. 17) is placed on the surface of the tongue by the right edge of its root, with the end portion having a ball-like massage element, the probe is led on the surface of the tongue's edge clockwise and counterclockwise 3–4 times for 3–5 seconds. Movements are carried out according to FIG. 8, the tongue is pricked around (FIG. 29) according to FIG. 10 and the tongue is then stroked along the same lies. All the procedures are carried out in 3–5 seconds 2–4 times. The point in the middle of the tongue is pressed (FIG. 26), pricked around (FIG. 29) and stroked by the probe (FIGS. 17, 18) from the root to the tip and back. Exposure: 5–7 seconds, action is repeated 3–5 times.

Sublingual massage is carried out by probes (FIGS. 18, 19, 26, 27, 28). The lower surface of the tongue is laid onto the surface of the probes, pressing the points by their massage elements which are disposed beneath the tongue and, along with this, the middle prong of the probe (FIGS. 26, 27, 28) is set onto the anterior lower teeth, the tongue is raised a little by the probes and the lower surface of the tongue is stroked by the same probes.

The enumerated probes are helpful in stretching the frenulum of tongue in children whereby to avoid surgial intervention as in the case with the shortened frenulum.

Exposure lasts 3–5 seconds, action is repeated 3–5 times. For the palate curtain to be massaged, use is made of probes (FIGS. 14, 15, 16, 17, 18, 19, 29), the horizontal part of a probe's operating member is arranged on the surface of the tongue, the tongue's root is fixed by a probe's massage thrust step, it is then released, thus lowering and stimulating the palate curtain. The procedure is repeated 3 times for 3–7 seconds.

Figures 22, 23, 24, 25:
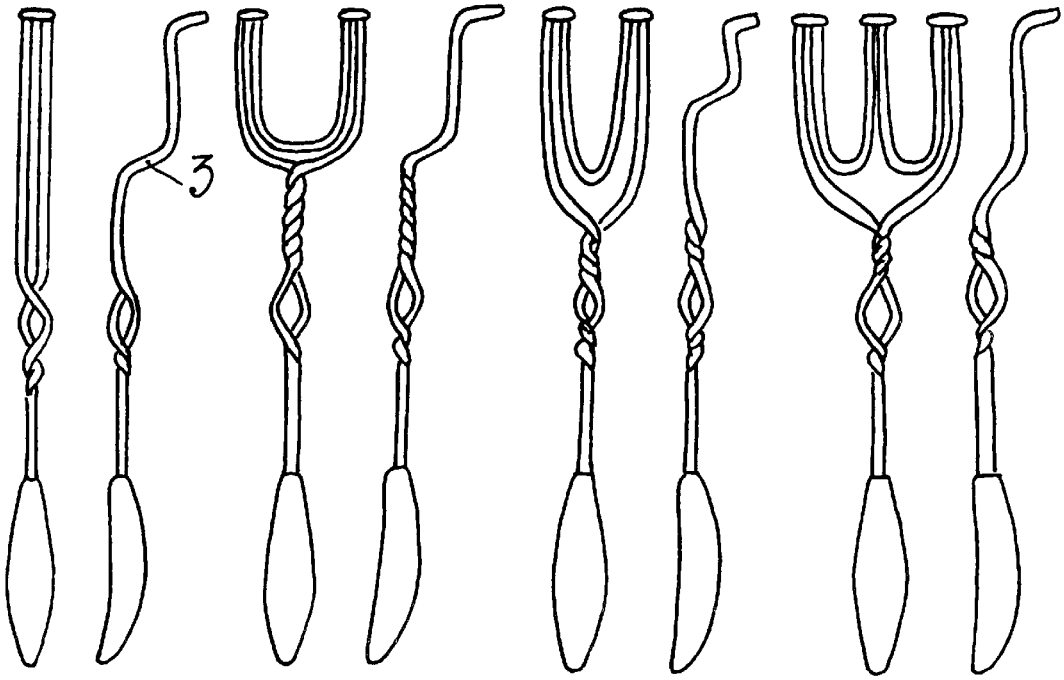

With onesided paresis, use is made of a probe (FIGS. 22, 23, 24) that is placed onto the immobile side of the tongue and a similar action is performed. In case of ⅔ of the tongue being affected by paresis, use is made of the probe (FIGS. 23, 24, 25). It is possible to use probes to fix the tongue with the aid of a ball-like thickening (FIGS. 14, 15, 16, 17) acting upon the palate curtain.

Figure 21:
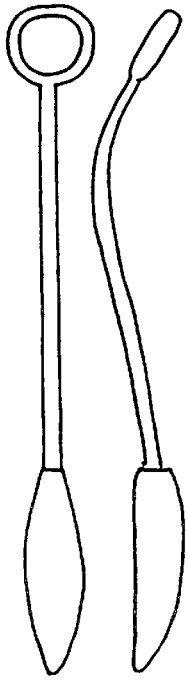
Figure 30:
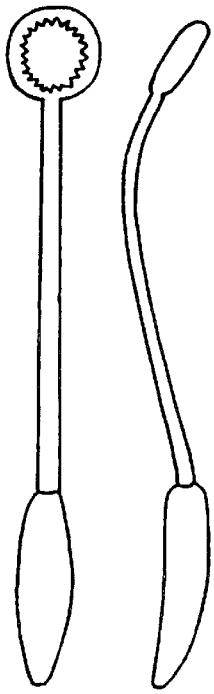

On massaging the uvula, use is made of a probe (FIG. 21) that is set on the uvula with its annular portion, movements being performed from bottom to top and back. The same procedure is then carried out by a probe (FIG. 30). Use is also made for the same purpose of probes (FIGS. 14, 15, 16, 17, 30). The uvula is pricked around by the probe as well (FIG. 29).

For the points of the rear wall of the pharynx to massaged by a probe (FIGS. 22, 23, 24, 25), the tongue is pulled and the rear wall of the pharynx is stroked by the probe (FIGS. 14, 15, 16, 17) counterclockwise, using a ball-like thickening.

3–5 minutes after, articulation-mimic exercises are done on the patient with the aim of developing a force, volume and reversibility of movements of the muscles of the speech organs accuracy and purposefulness of movement. And gymnastics may be whatever desired as to steps (procedures) and necessarily directed to providing the functions prescribed.

Articulation gymnastics includes exercises for cheeks, lip muscles, mandible, soft palate muscles, lips, mimic exercises of the face and eyes. 3–5 minutes after, breathing exercises are done to differentiate the oral and nasal breathing and to achieve a prolonged and smooth oral expiration under the control of movement of the diaphragm and the abdominal muscles. Gymnastics may be whatever desired to contribute to the aforesaid result. The general course of treatment is 45 days of daily seances with a repetition of said course of treatment 6 months after to secure an effect obtainable in case of a heavy form of dysarthria.

Figure 14:
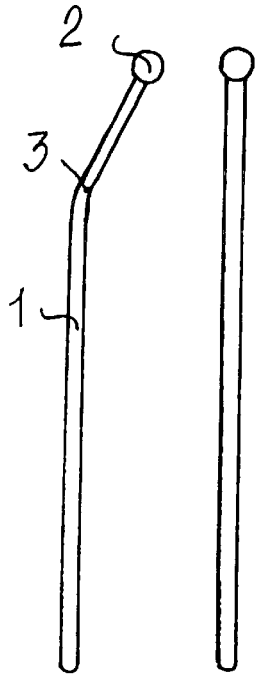
FIGS. 14–33 show the different designs of dysarthria probes: straight, ones with a curvature in the form of a massage thrust step, probes with operating parts in the form of two-prong units, three-prong units, spherical thickenings and rings one of which has acicular inner projections.
Figure 15:
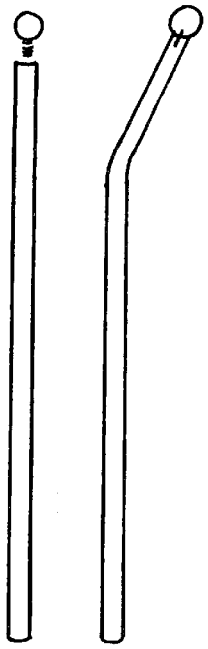
Figure 16:
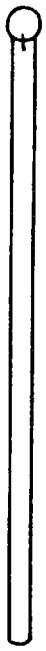
Figures 26, 27, 28:
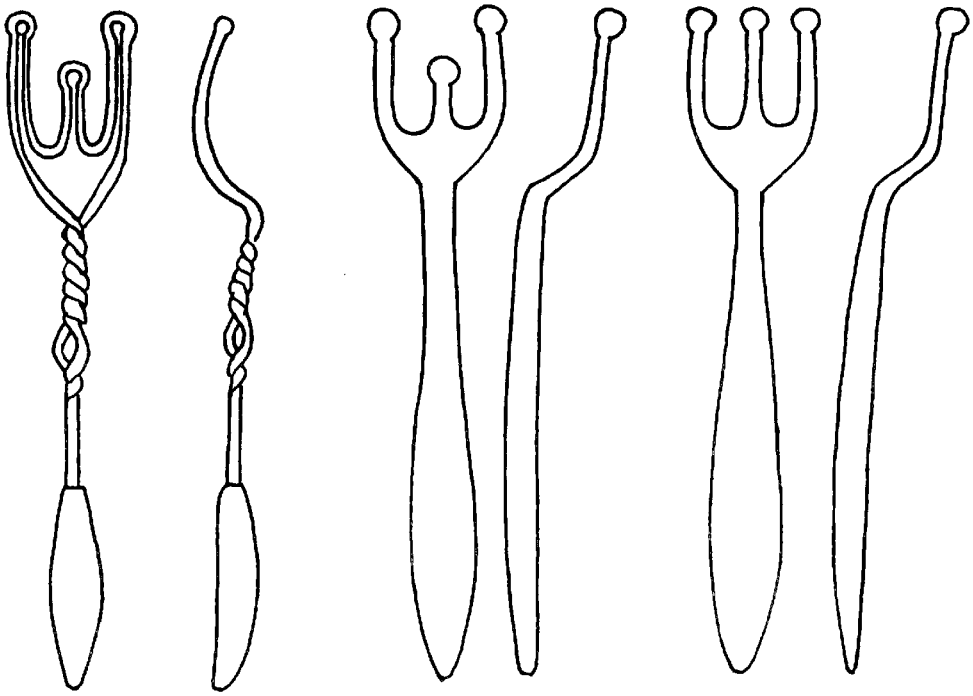

FIGS. 14–13 show a kit of dysarthria probes, which comprises a straight probe with a rod 1 and an operating part 2 in the form of a ball-like thickening (FIG. 16). a probe with a curvature in the form of a massage thrust step 3, having an operating part with a transverse end (FIG. 22), the additional groups of probes with operating parts 2 in the form of two-prong units (FIGS. 18, 19, 20). probes with the ball-like thickenings and ones with the rings being curved at an angle of 25°–45°, in the form of a rod (FIG. 22), a probe with a three-prong unit (FIG. 25) and part of probes of a group with two-prong units (FIGS. 23, 24) having curvatures in the form of a massage thrust step, the tapering rod configured as the needle 2 (FIG. 29), and the maximal cross-sectional area of each mushroom-like element (FIGS. 31, 32, 33) exceeding at least twice the cross-sectional area of each and every ball-like thickening. Made from ebonite are probes represented in FIGS. 17, 18, 19,27 28 31 32 33 From metals (copper or titanium or stainless steel) probes shown in FIGS. 14, 15, 16, 17, 26, 29,30 having detachable ball-like thickenings. The ball-like thickenings are globular or oval. An oval geometry is formed at the end where the prongs meet to form a common mass as is clearly shown in FIGS. 22–25 respectively. The probes with an operating part in the form of a two-prong unit (FIGS. 18, 19, 20), a three-prong unit (FIGS. 27, 28) have ball-like thickenings, provided on the faces of the operating part, in the form of a sphere or an oval. The probes with operating parts in the form of three-prong units (FIGS. 26, 27) have lateral prongs exceeding a middle prong or equal to it lengthwise (FIGS. 25. 28). The operating part of the probes represented in FIGS. 26–28 is oriented at an angle of 20° to 25°. The ball-like thickenings of the probes are oriented at an angle of 40° to 45° to the longitudinal axis. The faces of the operating parts of two-prong and three-prong units made of ebonite have ball-like thickenings in the form of a sphere or an oval. The straight probe (FIG. 22) and the probes with the operating parts in the form of two-prong and three-prong units (FIGS. 23–25) have the recurved ends of a plane oriented transversely of the operating part. The probes with operating parts in the form of a stream-lined mushroom element (FIG. 31) are made cylindrical and from FIG. 33 tapering towards the center.

Figure 20:
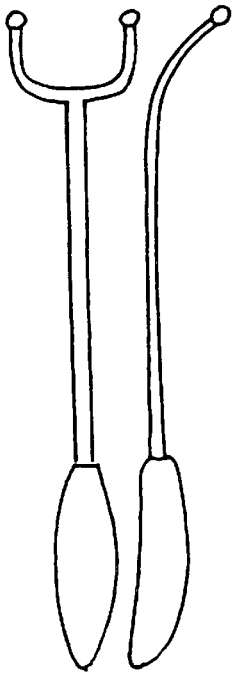

The angle between the prongs of an ebonite probe with an operating part in the form of a two-prong unit (FIG. 18) is obtuse, or right, or acute. The inner surface of the operating part of the ebonite probe in the form of the two-prong unit is configured as a semicircle (FIG. 19), U-shaped (FIG. 20). The through probe and probes with operating parts in the form of rings, two-prong units, three-prong units have handgripportions and connected with the grips for joint. A kit may contain a container, or a sheath, or a box for set of probes (not shown on the drawings).

Figure 31:
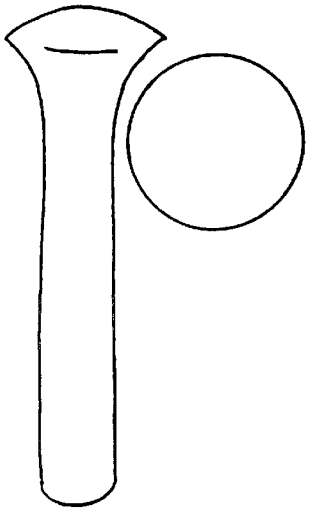
Figure 32:
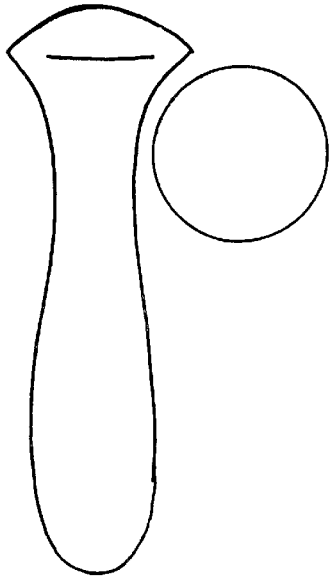
Figure 33:
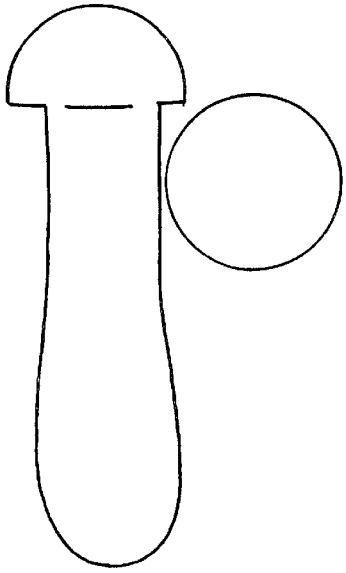

In the case of ebonite probes used for massaging the cervical-collar region, arms and face, use can be made of both ends as operating ones (FIGS. 31, 32, 33). They have a stream-lined mushroom shape, the cylindrical shape of a rod (FIG. 31), a tapered handgripportion towards the middle (FIG. 33) or towards the operating part with a maximal cross-section (FIG. 32). The shape of a grip of this type of probes is dictated by a convenient action produced on biologically active points and the possibility of a force required and sufficient for producing the action.

The use of probes of all the constructions contributes to conveniently arranging their massaging elements and them proper in difficultly accessible places in the patient's mouth in performing point massage operations as a result of a change in the structure of articulation organs, the possibility to create a sufficient force for acting on biologically active points. In case of tongue hyperkinesia, use is made of probes with an additional fixing portion of steped form (FIGS. 22–25) which makes it possible to reliably retain the tongue by the probe and does not interfere with the point massage of biologically active points.

The ebonite grips of probes have a smooth polished surface and serve as an auxiliary massage instrumentfor the face and cervical-collar region. All the probes are convenient in operation and do not cause fatigue when used by speech therapeutists.

A course of restoring speech functions in patients suffering from various forms of dysarthria includes a complex treatment by the successively performed cosmetic massage of the face, point action exerted by dysarthria probes of different configuration on the biologically active points of the face, cervical-collar region, arms and articulation organs, articulation-mimic and breathing exercises and restoration of speech/voice characteristics.

MODES OF CARRYING OUT THE INVENTION

EXAMPLE 1

Patient S., 26, admitted to the speech department of a daytime hospital, diagnosis: pseudobulbar spastic rigidity dysarthria.

A volume of movement of the tongue, lips and the jaw increased on the third day of treatment.

A tempo of speech accelerated on the seventh day of treatment, the lips became more mobile, the tongue began to rise up. The articulation—mimic mobility of muscles improved.

On the 15th day the tip of the tohgue began vibrating, the patient began pronouncing the sound "r". The restoration training resulted in positive dynamics: speech breath considerably improved, speech expiration prolonged, timbre improved, the voice became more modulated.

EXAMPLE 2

Patient E., 24, diagnosis: infantile cerebral paralysis, dysarthria of spastic-paretic form. Speech therapy examination: the amimic face, increased salivation. Restricted scope of movements of the tongue, lips, insufficient amplitude of movements. Movements are performed in slow tempo, quickly exhausted; the tone of tongue muscles enhanced. Speech pronounciation aspect: reduced vowels, indistinct, unclear sibilants replaced with dental sounds, speech intelligibility reduced because of a phonetic defect. Vocabulary of household words, phrase speech not formed. Superficial speech breath; short, weak expiration; an expiration force quickly exhausted in a speech flow, turns into speech on taking breath. Voice: sonorous, loud cry. Speech phonation: weak dull, monotonous, nasalized, exhausted; speech: toneless, with no melodical tint.

A complex treatment, as proposed, was used. Positive dynamics was observed. A considerable improvement in the state of pronouncing aspect of speech, pronounciation of sounds improved as is a prosodic shaping of utterances. Nasalized speech tint removed, speech tempo advanced. The hyperkinetic manifestations in the articulation organs disappeared, salivation diminished.

The muscles of articulation organs became less constrained as the result of point massage, with the use of dyarthria probes, their movements became more purposeful and accurate. The aim was to achieve unhurried speech tempo (easy articulation).

EXAMPLE 3

Patient I., 23, diagnosis: childbirth aftermath, subcortical dysarthria. Speech therapy examination: enhanced salivation, restricted scope of movements of the tongue and lips. Enhanced tongue tone. The pronouncing aspect of speech: articulation of vowels disturbed more than the consonants. Individual words and sounds can be pronounced correctly but at the moment of hyperkinesia theseturn out to be much distorted and unintelligible. The tempo, rhythm and melodics of speech upset. Voice constrained, sharp, hoarse, ranging in timbre and loudness. Sometimes voice "dies out", as it were, turning into a whisper.

A complex method of treatment was used. Positive dynamics after a course of treatment: a marked improvement of the pronouncing aspect of speech. Hyperkinetic manifestations in the muscles of articulation organs disappeared. At the same time there are some defects in pronunciation of sounds, more specifically, fricative sounds and affricates, insufficient expressiveness of utterances (intonation), speech scanned and retarded somewhat.

These results have been achieved by way of regular logopedic exercises with the use of point massage and dysarthria probes, which are directed to "mastering" each and every component of speech act associated with pronunciation (breathing, vocal formation, articulation).

Upon completion of the second course of treatment of the patient, a further regression was observed of dysarthria symptomatology, an isolated pronouncing of all the sounds except for sibilants and "r", normally, which require correction.

The muscles of organs participating in articulation became less constrained as the result of point massage, movements became more purposeful and accurate.

Reversibility improved from one articulation movement to another. A correct articulation usage of the sounds "s", "z", "ts", "sh", "zh", "ch", "l", "t", "d" assimilated. The sounds automated, differentiated in syllables, words, sentences, verses, tongue-twisters, proverbs. The aim is an unhurried speech tempo (easy articulating). The pronouncing side of speech corrected during signing, reading. Articulation of some sounds made more accurate in the words.

The method approbated on 94 patients, with prevalence of an average and heavy degree of dysarthria, with the pronounced pareses and coarse speech disturbances at the age of 15 to 60, a duration of illness of from 3 months to 7 years. The clinical effectiveness of treatment by the proposed method, using the dysarthria probes, is shown in Table 1.

TABLE 1

| Clinic effectiveness | Number of patients, absolute and in % | |
|---|---|---|
| | use of dysarthria probes in point massage | classic speech therapy |
| Considerable improvement | 23 (21.62%) | 15 (15%) |
| Improvement | 66 (62.04%) | 30 (30%) |
| Inconsiderable improvement | 2 (1.88%) | 7 (7%) |
| No changes | 1 (0.94%) | 42 (42%) |
| Changes for the worse | — | — |
| Total | 94 (100%) | 100 (100%) |

The complex treatment of restoration of the speech functions in patients suffering from dysarthria—cosmetic massage, articulation-mimic and breathing exercises, stimulation of biologically active points of the face, cervical-collar region, arms and articulation organs normalizes the musclar tone and restores the patient's speech functions.

The proposed complex method of treament can reduse the time of treatment up to 45 days, compared to traditional treatment of this deseases that lasts for years. The number of invalids suffering from serious dysarthria forms and cured by the proposed method is sharply reduced, the patients return to a nolmal way of life and work.

Industrial Applicability

The proposed invention will find an effective application in hospital conditions in curing patients having different dysarthria heaviness and also children suffering from infantile cerebral paralysis, in case of obliterated dysarthria form.

What is claimed is:

1. A dysarthria probe for exerting a reflex action on the patient's biologically active points inside the patient's mouth, for correcting speech disorders, said probe comprising an operating part and an elongated handle extending from the operating part with said operating part composed of a single prong in the form of a solid spherically shaped ball composed of metal or plastic composition and a curved section with the spherically shaped ball terminating at the distal end of the curved section, said curved section having a gradual curvature extending from the handle at an acute angle of no greater than 45° relative to a longitudinal axis extending through the handle for forming an arc which extends from said handle to said spherically shaped solid ball so that the probe upon insertion in the patient's mouth permits the single prong to be readily depressed and rolled against a biologically active point on the tongue or other location inside the patent's mouth at the posterior or anterior end thereof using simple turning movement of the handle.

2. A dysarthria probe for exerting a reflex action on the patient's biologically active points inside the patients mouth, said probe comprising an operating part and an elongated handle extending from the operating part with said operating part having two prongs and a curved section with each prong having one end meeting at a common point with the curved section to form a Y or U configuration and having an opposite free end terminating in a spherically shaped ball, said curved section having a gradual curvature extending from the handle to said common point to form an arc of at least part of a circle so that the probe upon insertion in the patient's mouth permits each prong to be readily depressed into contact against a biologically active point on the tongue or other location inside the patients mouth at the posterior or anterior end thereof using a simple turning movement of the handle, thereby correcting speech disorder.

3. A dysarthria probe for exerting a reflex action on the patient's biologically active points inside the patients mouth, said probe comprising an operating part and an elongated handle extending from the operating part with said operating part having two prongs each having one end meeting at a common point in a Y or U configuration and an opposite free end terminating in an oval shaped geometry and with said operating part further comprising at least two sections disposed in different planes at different levels relative to each other and to a longitudinal axis extending through the handle so that the probe upon insertion in the patient's mouth permits each prong to be readily depressed into contact against a biologically active point on the tongue, thereby correcting speech disorde or other location inside the patients mouth at the posterior or anterior end thereof for grabbing, stretching and/or massaging the patient's tongue.

4. A dysarthria probe for exerting a reflex action on the patient's biologically active points inside the patients mouth, said probe comprising an operating part and an elongated handle extending from the operating part with said operating part having three prongs with the intermediate of the three prongs being shorter in length relative to the length of the other two prongs and with one end of each of the three prongs meeting at a common location and the opposite end thereof having a spherical or oval shaped geometry and with said three prongs lying in a common plane on a level different from the plane of the longitudinal axis through said handle so that the probe upon insertion in the patient's mouth permits grabbing, stretching and/or massaging the patient's tongue, thereby correcting speech disorder.

5. A dysarthria probe as defined in claim 4 wherein said operating part further comprises at least two sections disposed in different planes at different levels relative to each other and to said longitudinal plane extending through the handle.

* * * * *